United States Patent [19]

Bullard

[11] Patent Number: 4,468,932

[45] Date of Patent: Sep. 4, 1984

[54] FAN COOLER

[76] Inventor: Terry S. Bullard, 4741 Lonewillow Ln., Virginia Beach, Va. 23455

[21] Appl. No.: 498,705

[22] Filed: May 27, 1983

[51] Int. Cl.[3] ..... F25D 3/02

[52] U.S. Cl. ..... 62/421; 62/425; 62/457; 62/530

[58] Field of Search ..... 62/457, 464, 372, 425, 62/420, 421, 430, 529, 530

[56] References Cited

U.S. PATENT DOCUMENTS

| | | | |
|---|---|---|---|
| 211,821 | 1/1879 | Wickes | 62/425 X |
| 1,909,261 | 5/1933 | Frazier | 62/425 X |
| 2,133,818 | 10/1938 | Hulse | 62/421 X |
| 2,262,405 | 11/1941 | Peterson | 62/421 |
| 2,988,901 | 6/1961 | Greene | 62/425 X |
| 4,325,230 | 4/1982 | Driscoll et al. | 62/530 X |

*Primary Examiner*—Lloyd L. King

[57] ABSTRACT

This invention is a portable ice chest, containing removable racks and trays for foods and beverages, replacable ice cubes and a fan driven by a battery powered motor.

1 Claim, 7 Drawing Figures

FAN COOLER

This invention relates generally to portable ice chests, such as are used, in warm seasons, to carry out-of-doors, foods and beverages at picnics, sports events, and the like.

It is well known that conventional such chests keep the food and beverages cool by means of pieces of ice placed loosely in the bottom of the chest, together with the beverage cans and bottles, so that, after a few hours, a person is obliged to submerge his hand in the melted cold ice water in order to retrieve a beverage. Also, it is to be noted that such cooling system, with ice at the bottom, does not effectively enough cool the sandwiches or other foods located higher up inside the chest. Accordingly, there is a need for an improvement in such ice chests.

Therefore, it is a principal object of the present invention to provide a new type of portable food and beverage chest, that is herein termed as a fan cooler, because it includes a fan that blows air around the ice, and then blows this cooled air around the food located in an upper part of the chest, so as to keep it cooler.

Another object is to provide a fan cooler, wherein the ice is confined to an ice compartment, and the melted ice water therefrom does not flood the area containing the beverage cans and bottles, thereby eliminating the need for a person to plunge a hand into cold ice water when reaching for a beverage.

Other objects are to provide a fan cooler, which is simple in design, inexpensive to manufacture, rugged in construction, easy to use, and efficient in operation.

These, and other objects, will be readily evident, upon a study of the following specification, and the accompanying drawing, wherein.

Figure 1:
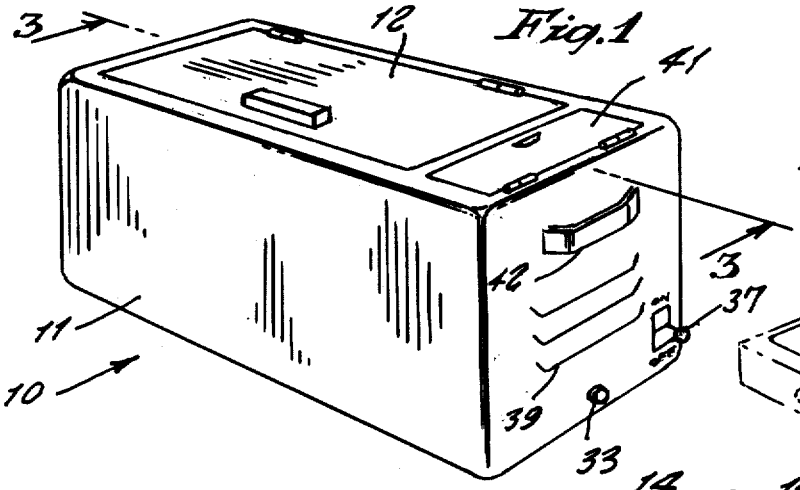
FIG. 1 is a perspective view of a preferred embodiment of the present invention.

Referring now to the drawing in greater detail, and more particularly to FIGS. 1 to 4 thereof, at this time, the reference numeral 10 represents a fan cooler chest, according to the present invention, wherein there is a case 11, made of an insulation material such as styrofoam or the like, and which includes a main top cover 12, made of a similar insulation material, and which may be either hinged, as shown, or freely removable. The top cover provides access to a food and beverage storage compartment 13, and also to an ice compartment 14, which is sandwiched between the compartment 13 and an inaccessible, small compartment 15, containing a fan 16.

Figure 2:
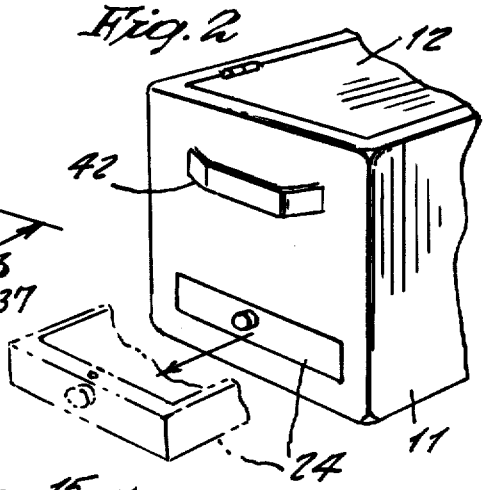
FIG. 2 is a fragmentary perspective view, showing an opposite end of the device.
Figure 3:
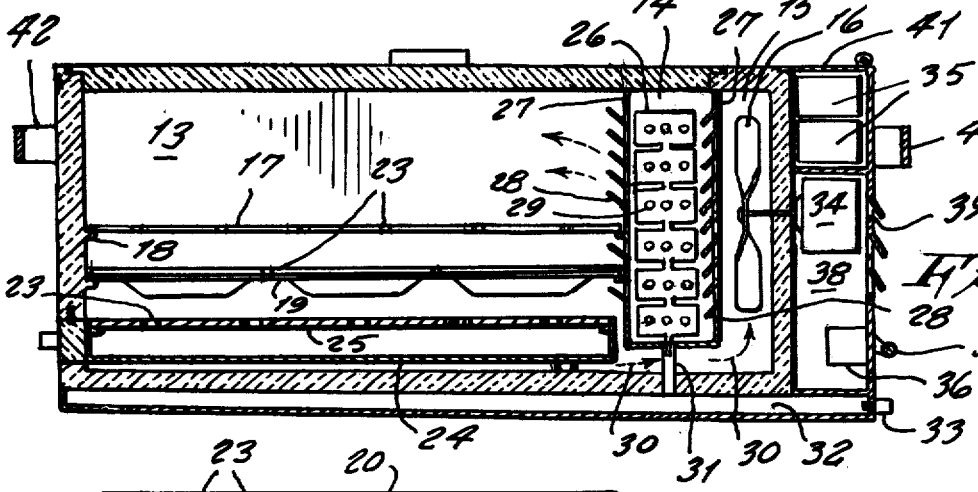
FIG. 3 is a cross-sectional view taken on line 3—3 of FIG. 1.
Figure 4:
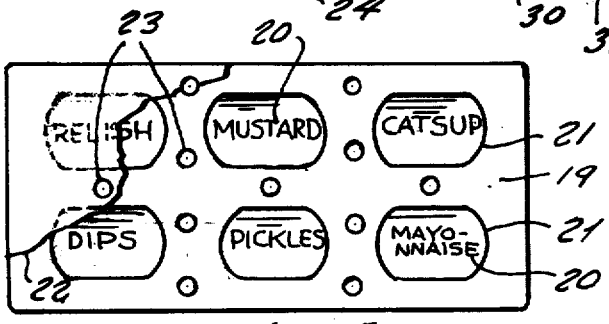
FIG. 4 is a top plan view of a condiment tray illustrated in FIG. 3, and showing, fragmentarily, a tray lid thereupon.

Within the compartment 13, one or more removable racks 17 are supported upon side rails 18, so as to utilize all the compartment space fully in food storage. A lowest rack would hold sandwiches. A rack above this would hold pretzels, bread, cookies, cake and potato chips, while a top rack would hold beverages. A tray 19 below the rack, holds condiments 20 in separate depressions 21. A removable lid 22 covers the tray. Vent openings 23 are provided through the racks, tray and tray lid, so as to allow air from the fan to circulate therethrough; such vent openings being also through a sliding tray 24 and its cover 25, located below the tray 19, and which is slidable outward of a side of the case, as shown in FIG. 2. This tray holds luncheon meats, lettuce, onion, tomatoes, frankfurters and hamburger patties. Alternately, the tray 24 may be made to keep moisture out.

The ice compartment receives special-shaped ice cubes 26, which are frozen in a special ice tray, placed in a home refrigerator freezer before being put into the chest 10. Opposite side walls 27, forming the ice compartment, have louvered openings 28, while the ice cubes are formed with holes 29 therethrough, so as to allow air from the fan to blow therethrough and cool the food and beverage compartment, from where the air re-circulates back to the fan, as shown by arrows 30. Water from the melting ice cubes drips down a tube 31 from the ice compartment, and into a water storage chamber 32, from where it can be drained out by removal of a drain plug 33.

The fan is driven by a motor 34, powered by batteries 35, in electrical circuit with a switch 36 controlled by external switch button 37. The motor is in an uninsulated chamber 38, having louvered openings 39, for allowing circulating outside air to cool off the motor. The batteries are in a battery chamber 40, accessible by a hinged or screw-secured cover 41, for easy battery replacement.

The case 11 is fitted with handles 42 on opposite ends for convenient carrying. A lock, not shown, may be included for locking the cover 12. Other conventional features may also be included.

Figure 6:
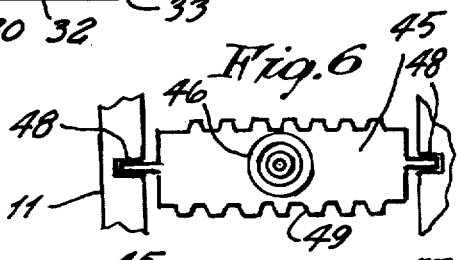
FIG. 6 is an enlarged top plan view of a typical ice cube assembly, shown in FIG. 5.
Figure 7:
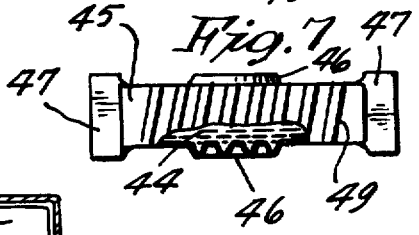
FIG. 7 is a side elevational view thereof.
Figure 5:
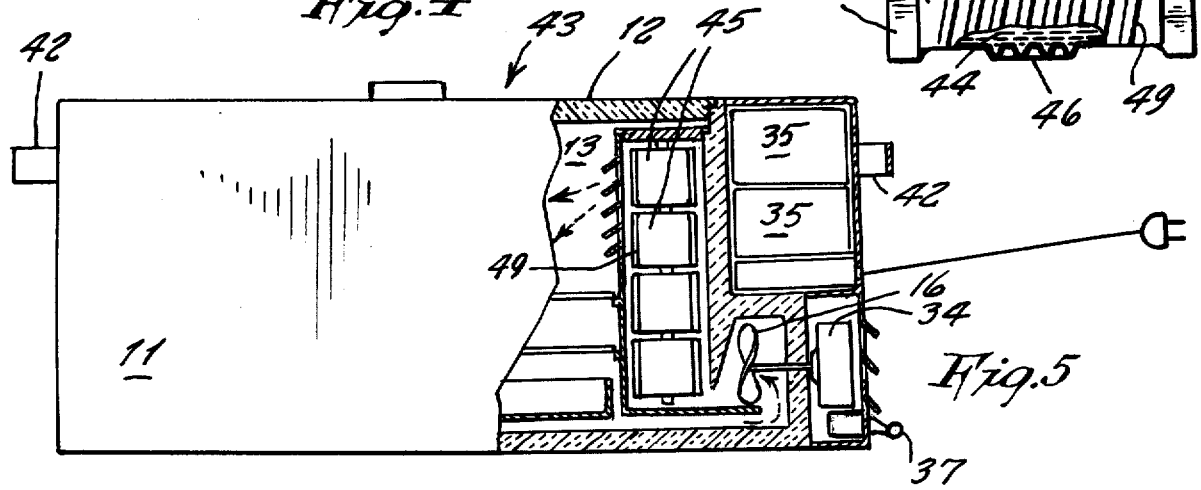
FIG. 5 is a side elevational view, shown partly in cross-section, and illustrating another design of the invention, wherein the problem of melted water from the ice cubes is eliminated.

Referring now to FIGS. 5 to 7, another design of fan cooler 43 is shown, which is generally similar to fan cooler 10, except that it does not have the problem of disposal of melted ice water. In this design, water or a dry ice gelatin 44 is hermetically sealed within expandible, flexible containers 45, which may be readily transferred between a home refrigerator freezer compartment and the ice chest compartment 14. Accordingly, each container is made either of rubber or a soft plastic, including expanding bulls eyes 46, for accommodating the expanding water or gelatin therein, and projections 47 on opposite ends slide into slots 48 of the opposite side walls of the fan cooler case 11. Grooves 49, on opposite side walls of each container 44, extend diagonally inclined from a vertical direction, so that air circulating upwardly through the ice compartment 14 has a maximum time of contact therewith, for thermal temperature transfer. In this design, when the water or gelatin melts, it stays inside the container 45, which then is simply placed back into the home refrigerator freezer, for being refrozen again.

While various changes may be made in the detail construction, it is understood that such changes will be within the spirit and scope of the present invention, as is defined by the appended claims.

What I now claim is:

1. A fan cooler, comprising, in combination, a case of insulation material, a removable top cover of insulated material on said case, a food and beverage compartment, an ice compartment and a fan chamber in said case, said ice compartment being between said food and beve age compartment and said fan chamber, so that cold air from said ice chamber is blown into said food and beverage compartment; a fan being within said fan chamber and a battery powered refrigerator freezer, being removably placed in said ice compartment, and said ice cubes including means for being refrozen again, said means comprising each said ice cube constituting a hermitically sealed container of flexible material and including an expandable bull's eye, and a dry ice gelatin within said container; means for said ice cubes being arranged in a row within said ice compartment and air from said fan being blown along said row; and each said ice cube container including a plurality of grooves on its side walls, said grooves being angularly inclined respective to said row for maximum contact time with said air.

* * * * *